US005511703A

United States Patent [19]

Ryerson

[11] Patent Number: 5,511,703

[45] Date of Patent: Apr. 30, 1996

[54] TRADESMAN'S TOOL BELT

[75] Inventor: Wayne R. Ryerson, Mine Hill, N.J.

[73] Assignee: W.G.H., Inc., Mine Hill, N.J.

[21] Appl. No.: 274,579

[22] Filed: Jul. 13, 1994

Related U.S. Application Data

[63] Continuation of Ser. No. 111,186, Aug. 24, 1993, abandoned.

[51] Int. Cl.[6] ..... A45F 3/00

[52] U.S. Cl. ..... 224/224; 224/904

[58] Field of Search ..... 224/904, 224, 224/195, 223, 227, 232, 234, 249, 253; D3/226, 227, 228, 229

[56] References Cited

U.S. PATENT DOCUMENTS

| | | | |
|---|---|---|---|
| D. 342,831 | 1/1995 | Dise | D3/228 |
| 793,726 | 7/1965 | Kerney | 224/223 |
| 1,603,044 | 10/1926 | Gise | 224/223 |
| 1,955,650 | 4/1934 | Obarski | 224/224 |
| 4,384,372 | 5/1983 | Rector | 2/300 |
| 4,579,265 | 4/1986 | Schiller | 224/224 |
| 4,747,527 | 5/1988 | Trumpower, II | 224/224 |
| 4,782,535 | 11/1988 | Yewer, Jr. et al. | 2/321 |
| 4,986,459 | 1/1991 | Yarbrough, Jr. | 224/904 X |
| 5,040,524 | 8/1991 | Votel et al. | 128/78 |
| 5,163,591 | 11/1992 | Leiserson et al. | 224/223 X |
| 5,201,448 | 4/1995 | Schue | 224/904 X |
| 5,205,448 | 4/1993 | Kester et al. | 224/151 |

FOREIGN PATENT DOCUMENTS

| | | | |
|---|---|---|---|
| 8803461 | 5/1988 | WIPO | 224/904 |

*Primary Examiner*—David J. Walczak
*Attorney, Agent, or Firm*—Emil Richard Skula

[57] ABSTRACT

A tradesman's tool belt having integral back support. The belt has an elongated flexible member having a section sufficiently wide to effectively provide back support to a wearer. At least one tool pocket is mounted to the flexible member. Preferably, at least one tool pocket is angulated with respect to the longitudinal axis of the belt. Tools mounted in the angulated tool pockets tend to be retained therein when the tradesman is crouching, crawling or bending over and are, overall, easily accessible.

14 Claims, 3 Drawing Sheets

TRADESMAN' S TOOL BELT

This is a continuation of application Ser. No. 08/111,186 filed on Aug. 24, 1993, now abandoned

TECHNICAL FIELD

The field of art to which this invention relates is tool belts, in particular, tradesmen's tool belts.

BACKGROUND OF THE INVENTION

In order to perform various tasks in their given trades, tradesmen, including electricians, carpenters, linemen, plumbers and the like, use tool belts to suspend various tools that are frequently used. The tool belts conventionally used by tradesmen typically have pouches or loops mounted to a belt. The pouches and loops contain or suspend a variety of tools, some or all of which may be needed for a particular job. For example, in the case of an electrician, the tool belt may contain pliers, wire strippers, rules, knives, diagonal cutters, wrenches, and the like. A tradesmen's tool belt when loaded with a complete compliment of tools may weigh in excess of fifteen pounds. It is known that, because of the biomechanics involved, the wearing of a conventional tool belt can stress a tradesman's back, particularly the lower back. In some instances, the stress over time can result in back injuries which may prevent the tradesman from working in the trade. In addition, a tradesman often is required to lift or move heavy objects such as ladders, pipe, etc., while wearing a tool belt. Such moving and lifting may compound the stress resulting from the wearing of a conventional tool belt. Several attempts have been made to overcome these deficiencies. For example, U.S. Pat. No. 4,384,372 discloses a wide back support for a police officer. The back support includes an outer support panel of relatively stiff leather which is sewn to a resilient foam material encased in fabric. Slots in the support form belt loops so that the back support can be attached directly to the trouser supporting belt of the wearer. Pairs of horizontal slots receive other loops to allow equipment or tools to be suspended from the wide back brace.

U.S. Pat. No. 4,782,535 discloses a belt which may be used for support and has particular application in weight lifting, kidney support or other protection. It may be used for belts for tool holsters. It is of a construction utilizing a plurality of layers. One of the layers is an elastically, yieldingly compressible and shape-restoring material. The belt has a contracted or relaxed state memory adapted to conform to an individual. The belt has a sandwich type construction including three layers: an intermediate, central firm elastomer layer, and inner and outer layers of durable wear resistant fabrics which are preferably stretchable.

U.S. Pat. No. 5,040,524 discloses a back support for providing abdominal and lumbosacral support. The back support has a waist band and an elastic band operatively connected to the outer surface of the waist band The waist band has a V-shape. The back support may have a tool belt operatively connected thereto. A belt may be inserted into loops mounted to the back support. Loops may be hung from the belt for supporting tools or the like.

U.S. Pat. No. 5,205,448 discloses a camera bag with waist belt support. The camera bag is mounted to the belt by a second belt which is threaded through loops on both the camera bag and the belt.

The back supports known in the art are typically complex structures. Although such back supports have been described as being capable of modification by hanging tool belts or tool loops from them, there are many disadvantages associated with hanging tools. For example, a tradesman such as an electrician, must frequently work in awkward, tight confined spaces such as attics, crawl spaces and utility corridors or tunnels. For safety and efficiency, the tools must be accessible quickly. Conventional tool belts, wherein tools are hung from loops or holsters, do not position the tools in a fixed position when the tradesmen is bending, crawling or otherwise in a contorted position. The tools tend to act under the force of gravity like a plumb bob with resultant rotation with respect to the tool belt (aligning the tool in the direction of the force of gravity), and thus the location assumed by the tool is typically different from the at-rest position which the tradesman remembers. A tradesman wearing a tool belt tends to have a spatial memory of the location of each tool allowing for the retrieval of the tool without looking at the tool belt or the tool. Thus, the tradesman in an emergency situation may reach for the tool based upon his spatial memory of the tool's normal resting position. However, the tool has likely moved and the tradesman must waste precious time groping and feeling for the tool. Yet another disadvantage of conventional tool belts is that tools may fall out of the tool belt when the tradesman is crawling or bending.

What is needed in this art are tool belts having a simplified structure which have back support capability yet maintain tools in a fixed, accessible position.

DISCLOSURE OF THE INVENTION

Therefore, it is an object of the present invention to provide a tradesman's tool belt which has integral back support and is easy and relatively inexpensive to manufacture.

It is a further object of the present invention to provide a tradesman's tool belt which maintains tools in a fixed position so that they may be readily located by the tradesman in low light and adverse conditions as well as in emergencies.

It is still a further object of the present invention to provide a tool belt which helps maintains tools in tool pockets when the tradesman is crawling bending or otherwise maneuvering in confined spaces.

Accordingly, a tradesman's tool belt is disclosed. The tool belt has an elongated flexible member having a pair of opposed ends, a longitudinal axis and an inner surface and an outer surface. The tool belt has back support means for a wearer's back. Preferably, the back support means extends from the elongated flexible member. The tool belt additionally has means for locking the ends of the flexible member together. A plurality of tool pockets is mounted to the outer surface of the flexible member. At least one of the tool pockets is angulated with respect to the longitudinal axis of the flexible member. The angulated tool pockets are preferably mounted on the elongated member in sections of the belt adjacent to a wearer's sides.

Yet another aspect of the present invention is a tradesman's tool belt which has an elongated flexible member having a pair of opposed ends, a longitudinal axis and an inner surface and an outer surface. The tool belt has back support means for a wearer's back. Preferably, the back support means extends from the elongated flexible member. The tool belt additionally has means for locking the ends of the flexible member together. A plurality of tool pockets is mounted to the outer surface of the flexible member. At least one of the tool pockets is angulated with respect to the longitudinal axis. At least one tool pouch is mounted to the elongated member. The angulated tool pockets are preferably mounted on the elongated member in sections of the belt adjacent to a wearer's sides.

Still yet another aspect of the present invention is a tradesman's tool belt which has an elongated flexible member having a pair of opposed ends, a longitudinal axis and an inner surface and an outer surface. The tool belt has back support means for a wearer's back. The back support means preferably extends from the elongated flexible member. The tool belt additionally has means for locking the ends of the flexible member together. At least one tool pouch is mounted to the elongated member.

The foregoing and other features and advantages of the present invention will become more apparent from the following description and accompanying drawings.

DESCRIPTION OF PREFERRED EMBODIMENT

Figure 1:
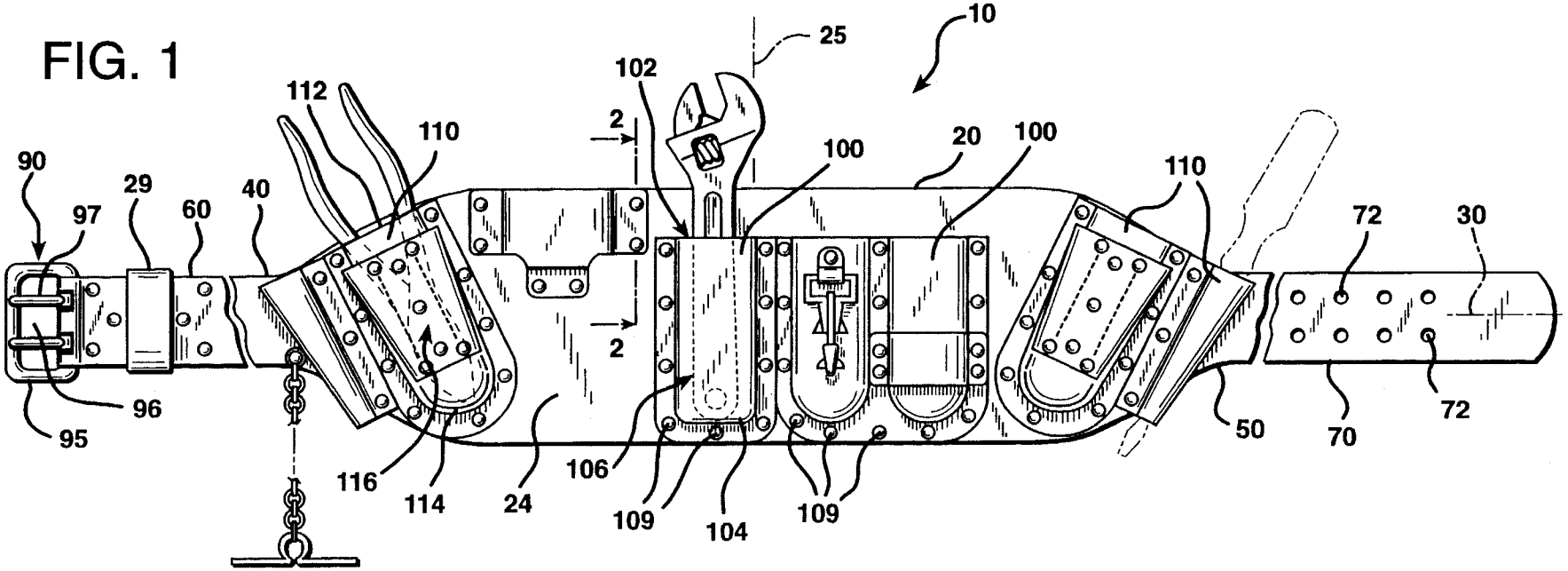
FIG. 1 is a plan view of a tool belt of the present invention containing assorted tools and showing the tool pockets, including tool pockets which are angulated with respect to the longitudinal axis of the tool belt; an integral back support is also seen.
Figure 2:
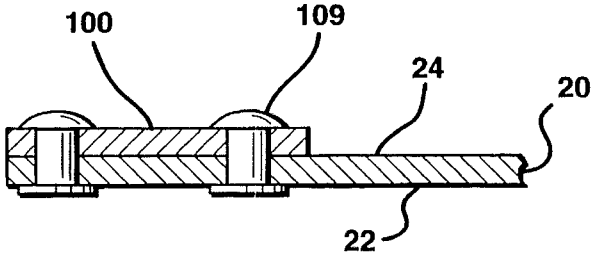
FIG. 2 is a is a partial cross-sectional view of the tool belt of FIG. 1 taken along View Line 2—2.
Figure 3:
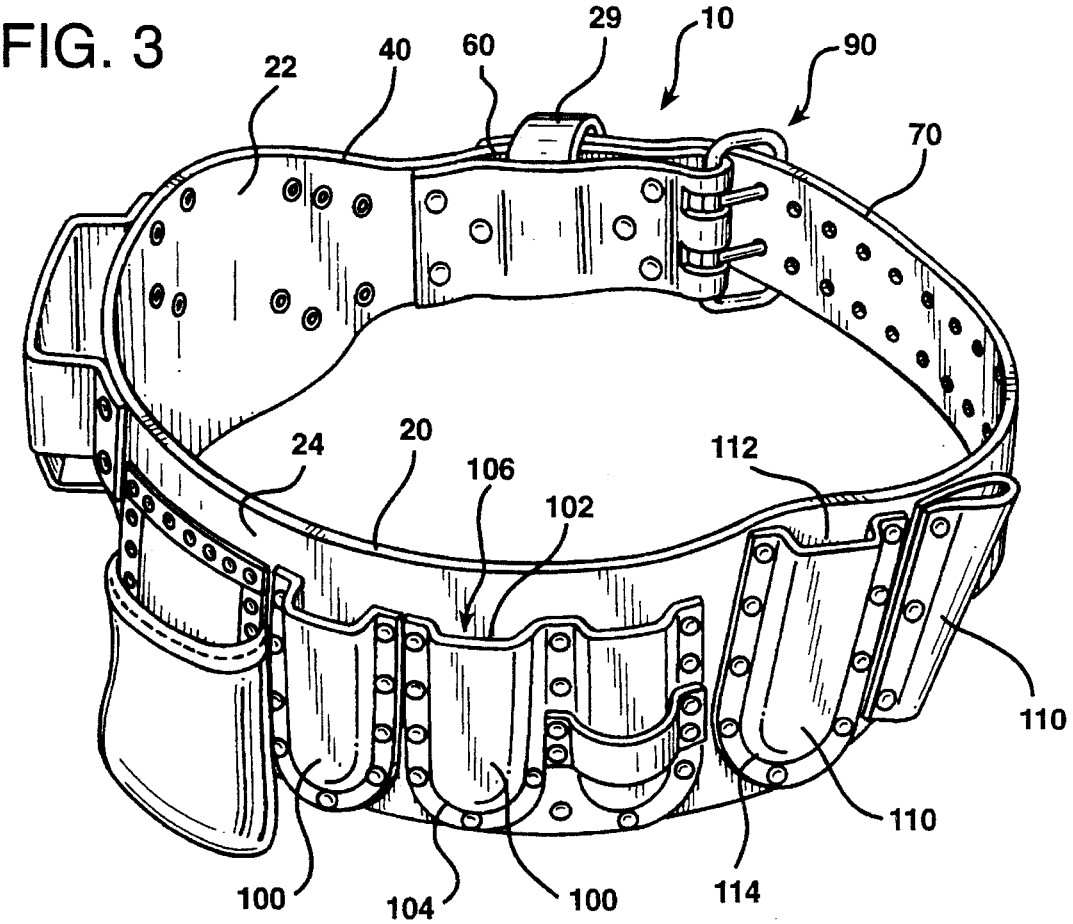
FIG. 3 is a perspective view of the tool belt of the present invention.
Figure 4:
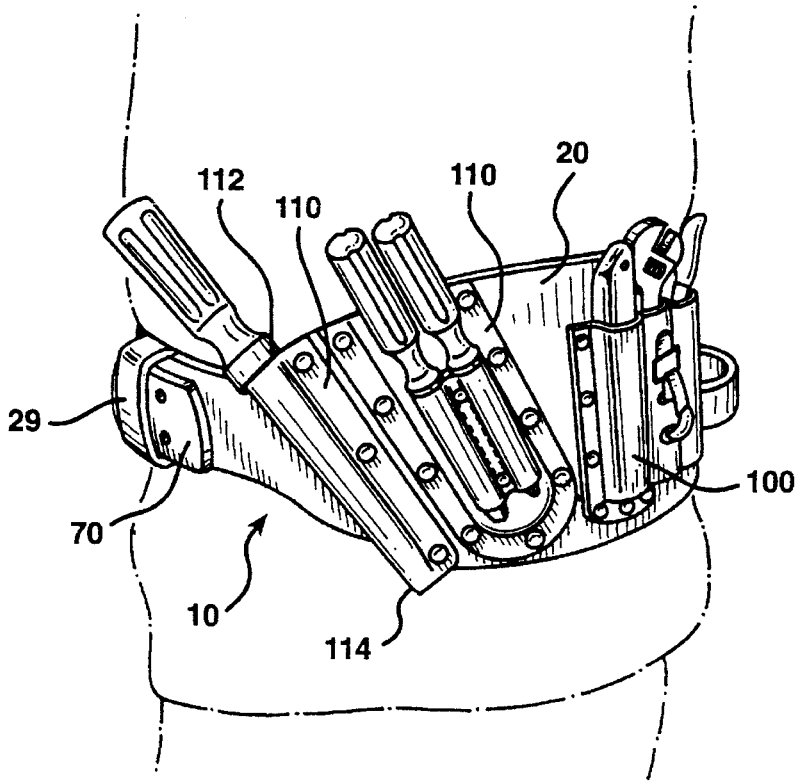
FIG. 4 is a side view of the tool belt of the present invention as worn by a tradesman; tools are seen in the tool pockets and several tool pockets are seen to be angulated.

Referring to FIGS. 1, 2, 3 and 4, a tool belt 10 of the present invention is illustrated. The tool belt 10 is seen to have a flexible, elongated member 20 having longitudinal axis 30 and latitudinal axis 25. Elongated member 20 is seen to have opposed ends 40 and 50. Member 20 is also seen to have inner surface 22 and outer surface 24. Extending from end 40 is the strap member 60. Strap member 70 is seen to extend from end 50. The straps 60 and 70 may be mounted to member 20 using conventional methods or extend from ends 40 and 50 if the member 20 and straps 40 and 50 are cut from a continuous piece of material. The member 20 is seen to substantially wider than strap member 60 and 70. The member 20 is sufficiently wide to effectively provide back support to the lower back of a wearer. Typically member 20 will have a maximum width of about 4.5" to about 7.5" more typically about 5.5" to about 7", and preferably about 6" to about 6.5". Member 20 may have a constant width or may taper from a maximum width at its center to a minimum width at end 40 and 50. Tool belt 10 as illustrated in FIG. 1 is seen to taper toward ends 40 and 50 such that ends 40 and 50 are substantially the same width as straps 60 and 70. Member 20 is seen to have a configuration similar to that of conventional weight lifting belts. Member 20 provides integral back support due in part to its width.

Mounted to the strap 60 is the belt buckle 90. Belt buckle 90 may be any conventional belt buckle and is preferably a belt buckle of the type having a frame 95. Frame 95 is seen to have opening 96 for receiving strap 70. Members 97 are pivotally mounted to one side of the frame 95. Strap 70 is seen to contain a plurality of holes 72 aligned for receiving members 97. When strap 70 is inserted into opening 96, members 97 are engaged in holes 72. The end of strap 70 is engaged in loop member 29. Buckle 90 may also consist of a conventional lever and cam type buckle having an opening for receiving strap 70 which compresses strap 70 to lock it in a fixed position. Or, buckle 90 may be any conventional belt fastening device. It will be appreciated by those skilled in the art that the strap members 60 and 70 may be replaced by mounting the member 20 to a conventional belt, such as a belt used to hold up trousers or a slightly larger version thereof. In such a configuration member 20 may be fastened to the belt using conventional fastening methods or the belt could be threaded through loops mounted to member 20.

Mounted to the outer surface of the member 20 are the tool pockets 100. The tool pockets 100 are preferably substantially rigid, molded members which are mounted directly to the outer surface 25 of member 20 using conventional fasteners such as rivets 109, and the like. The tool pockets 100 and 110 are preferably molded to conform to the configuration of particular tools, e.g., 10 electrician's pliers. However, it is not required that pockets 100 be rigid. Tool pockets 100 are seen to have open mouth 102, a closed bottom 104 and interior cavity 106 for receiving a tool. The tool pockets may also be sewn to the member 20 or may be sewn and reinforced with conventional fasteners, and the like. The pockets 100 and 110 are sufficiently deep (i.e., long) to effectively contain tools. As previously mentioned, belt 10 prior to mounting tool pockets 100 and 110 may be made from a single continuous piece of material or several pieces may be joined together, e.g., member 20 may be a separate piece.

It can be seen that pockets 110 are mounted at an angle with respect to longitudinal axis 30 of member 20. The mouth 112 of each tool pocket 110 is seen to be pointed toward the straps 60 or 70 while the bottom 114 of the pockets 110 are pointed toward the latitudinal axis 25 of the member 20. The pockets 110 are angulated sufficiently to effectively prevent tools from falling out of the inner cavity 116 of tool pockets when the wearer or tradesman is bending or crawling. The tool pockets 110 are also angulated sufficiently to effectively provide access to the tools contained therein while the tool belt 10 is being worn by the tradesman. When wearing a tool belt 10 of the present invention, it will be appreciated that tool pockets mounted to the member 20 in areas adjacent to the sides of a wearer would be difficult to retrieve if not angulated. Typically, the tool pockets 110 will be angulated with respect to longitudinal axis 30 about 50 degrees to about 70 degrees, more typically about 50 degrees to about 60 degrees, and preferably about 57 degrees to about 59 degrees. The tool pockets 110 are preferably mounted to sections of the flexible member 20 such that the tool pockets 110 are adjacent to a side of the wearer. It is believed that, although not desiring to be held to any particular theory, the reason why tools may not fall from tool pockets 110 when the tradesman is bending or crawling is that the pockets 100 and 110 are designed for a single, particular tool, fitted deeply and snugly and the angulated pockets 110 will typically not allow the tool angle to go below an angle wherein it may release from the tool pocket when crawling or working in tight places.

Figure 5:
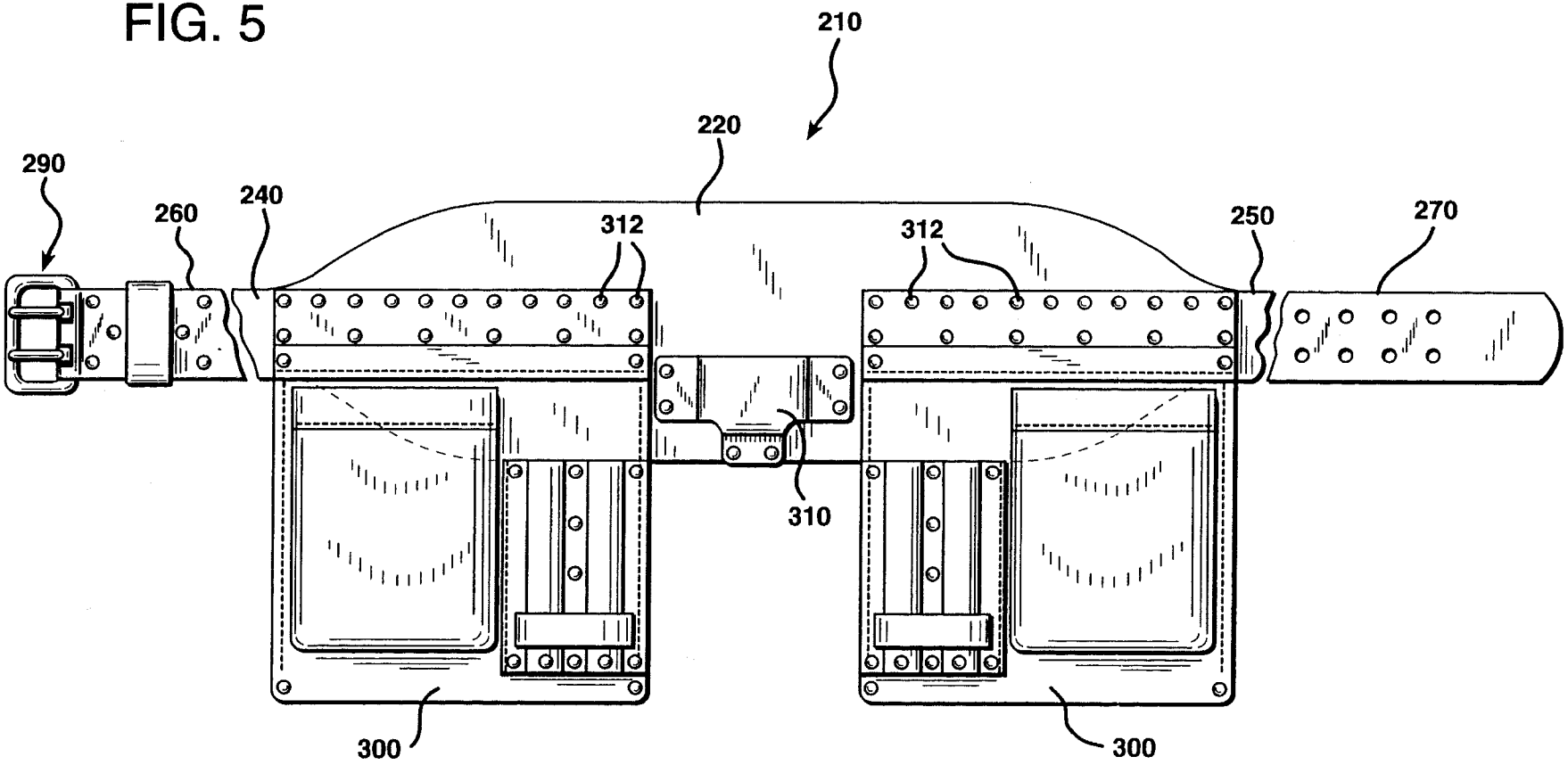
FIG. 5 is a plan view of an alternate embodiment of the tool belt of the present invention wherein tool pouches are mounted to the tool belt.

An alternate embodiment of the tool belt of the present invention is seen in FIG. 5. The tool belt 210 is seen to have elongated member 220 having longitudinal axis 230. Member 230 is seen to have straps 260 and 270 extending from ends 240 and 250. Belt buckle 290 is seen to be mounted to strap 270. Two conventional tool pouches 300 are seen to be mounted to member 220 by rivets 302. A molded tool pocket 310 is seen to be mounted to member 220 with rivets 312. Angulated tool pockets such as tool pockets 110 may also be mounted to the member 220.

The tool belts 10 and 210 of the present invention are preferably made from leather although other man-made substitutes could be used including woven and non-woven fabrics such as canvas, webbing, leather substitutes, polymeric materials, natural or synthetic rubbers, combinations thereof and the like. The tool pockets are preferably made from leather but also may be made from man-made materials such as leather substitutes, canvas, cloth, polymeric materials and the like.

The tool belts 10 and 210 of the present invention have many advantages. It is now possible for a tradesman to use a tool belt which both supports his lower back yet positively maintains tools in a fixed position allowing for ease of retrieval from the tool belt. Often, a tradesman is working in an unlit or cramped area where he must locate a tool on the tool belt by feel and spatial memory. Searching for a tool which has shifted on the tool belt could be life threatening, particularly in emergency situations. In addition, the tool belts 10 and 210 have an angulated tool pocket design feature wherein tools tend to remain fixed in the tool belt 10 when the tradesman is crawling or bending while being readily accessible under substantially all conditions and situations. Additional advantages include support while lifting or moving heavy objects, equal weight distribution and tool retention due to all pockets being designed and constructed to fit specific tools such as wire strippers, carpet knives, linesman's pliers, etc.

Although this invention has been shown and described with respect to detailed embodiments thereof, it will be understood by those skilled in the art that various changes in form and detail thereof may be made without departing from the spirit and scope of the claimed invention.

I claim:

1. A tool belt, comprising:

an elongated, flexible member having a pair of opposed ends, said member having a longitudinal axis, an inner surface and an outer surface;

means for locking the ends of the member together;

means for supporting a wearer's back extending from the flexible member and having an upper edge and a lower edge, wherein the back support means comprises at least one section of the elongated member which is sufficiently wide to effectively provide support to a wearer's back; and, a plurality of molded tool pockets fixedly mounted to the outer surface of the elongated member such that the pockets are stationary with respect to the elongated member wherein at least one of the tool pockets is positioned entirely between said upper edge and said lower edge of said back support means and is angulated at an acute angle with respect to the longitudinal axis and wherein each tool pocket comprises a member having an open mouth, a closed bottom, and a cavity for receiving tools, wherein the tool pocket is molded such that the it corresponds to the shape of a particular tool.

2. The tool belt of claim 1 wherein the locking means comprises:

a first strap extending from one end of the elongated member and a second strap extending from the other end of the elongated member; and, buckle means mounted to the first strap for receiving and engaging the second strap.

3. The tool belt of claim 2 wherein the buckle comprises a rectangular frame having a central opening for receiving said second strap, said buckle having at least one elongated member pivotally mounted to the frame and wherein the second strap additionally comprises a plurality of holes therethrough for receiving the at least one pivotally mounted member.

4. The tool belt of claim 1 wherein the tool pockets are mounted to the elongated member with rivets.

5. The tool belt of claim 1 wherein the flexible member is mounted to a belt having ends, and the end locking means comprises means for locking the ends of the belt together.

6. A tool belt, comprising:

an elongated, flexible member having a pair of opposed ends, said member having a longitudinal axis, an inner surface and an outer surface;

means for locking the ends of the member together;

means for supporting a wearer's back extending from the flexible member and having an upper edge and a lower edge, wherein the back support means comprises at least one section of the elongated member which is sufficiently wide to effectively provide support to a wearer's back; and, a plurality of molded tool pockets fixedly mounted to the outer surface of the elongated member such that the pockets are stationary with respect to the elongated member wherein at least one of the tool pockets is positioned entirely between said upper edge and said lower edge of said back support means and is angulated at an acute angle with respect to the longitudinal axis and wherein each tool pocket comprises a member having an open mouth, a closed bottom, and a cavity for receiving tools, wherein the tool pocket is molded such that it corresponds to the shape of a particular tool; and, at least one tool pouch fixedly mounted to the outer surface of the elongated member.

7. The tool belt of claim 6 wherein the locking means comprises:

a first strap extending from one end of the elongated member and a second strap extending from the other end of the elongated member; and, buckle means mounted to the first strap for receiving and engaging the second strap.

8. The tool belt of claim 7 wherein the buckle comprises a rectangular frame having a central opening for receiving said second strap, said buckle having at least one elongated member pivotally mounted to the frame and wherein the second strap additionally comprises a plurality of holes therethrough for receiving the at least one pivotally mounted member.

9. The tool belt of claim 6 wherein the tool pockets are mounted to the elongated member with rivets.

10. The tool belt of claim 6 wherein the flexible member is mounted to a belt having ends, and the end locking means comprises means for locking the ends of the belt together.

11. A tool belt, comprising:

an elongated flexible member having a pair of opposed ends, said member having a longitudinal axis, an inner surface and an outer surface;

means for locking the ends of the member together;

means for supporting a wearer's back extending from the flexible member and having an upper edge and a lower edge, wherein the back support means comprises at least one section of the elongated member which is sufficiently wide to effectively provide support to a wearer's back; and, at least one tool pouch fixedly mounted to the outer surface of the elongated member such that the pouch is stationary with respect to the elongated member positioned entirely between said upper edge and said lower edge of said back support means and angulated at an acute angle with respect to said longitudinal axis.

12. The tool belt of claim 11 wherein the locking means comprises:

a first strap extending from one end of the elongated member and a second strap extending from the other end of the elongated member; and, buckle means mounted to the first strap for receiving and engaging the second strap.

13. The tool belt of claim 12 wherein the buckle comprises a rectangular frame having a central opening for receiving said second strap, said buckle having at least one elongated member pivotally mounted to the frame and wherein the second strap additionally comprises a plurality of holes therethrough for receiving the at least one pivotally mounted member.

14. The tool belt of claim 11 wherein the flexible member is mounted to a belt having ends, and the end locking means comprises means for locking the ends of the belt together.

* * * * *